US006321968B1

(12) United States Patent
Remerowski

(10) Patent No.: US 6,321,968 B1
(45) **Date of Patent: *Nov. 27, 2001**

(54) COMBUSTION CHAMBER DESIGN FOR PROPELLANT CHARGES AND POWER ADJUSTMENT MEANS

(75) Inventor: David L. Remerowski, Cincinnati, OH (US)

(73) Assignee: Senco Products, Inc., Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/150,522

(22) Filed: Sep. 10, 1998

(51) Int. Cl.[7] ..... B25C 1/14
(52) U.S. Cl. ..... 227/10; 227/9
(58) Field of Search ..... 227/10, 9, 11, 227/8

(56) References Cited

U.S. PATENT DOCUMENTS 3,171,131 * 3/1965 De Caro et al. ..... 227/10
3,248,032 * 4/1966 Bochum, Jr. ..... 227/11
3,559,449 * 2/1971 Steinmetz ..... 227/8
3,777,382 * 12/1973 Brunelle ..... 227/10
3,973,708 * 8/1976 Scotoni ..... 227/10
3,981,424 * 9/1976 Maier ..... 227/10
4,063,672 * 12/1977 Dorgnon et al. ..... 227/9
4,068,790 * 1/1978 Osterle et al. ..... 227/10
4,153,219 * 5/1979 Jochum ..... 227/10
4,595,134 * 6/1986 Jochum ..... 227/10
4,883,212 * 11/1989 Philipp ..... 227/9
5,029,744 * 7/1991 Pai ..... 227/9
5,699,948 * 12/1997 Lee ..... 227/10
5,732,869 * 3/1998 Hirtl ..... 227/10
5,767,434 * 6/1998 Hirtl et al. ..... 227/10

* cited by examiner

*Primary Examiner*—Scott A. Smith
(74) *Attorney, Agent, or Firm*—Frost Brown Todd LLC

(57) ABSTRACT

A combustion chamber featuring an orifice plate which promotes complete, clean, and consistent combustion of the propellant charge used in a powder actuated tool. The combustion chamber allows extended operation of a power adjustment which has improved energy variance, a higher range of power adjustment, and complete clean combustion at any power level.

13 Claims, 6 Drawing Sheets

COMBUSTION CHAMBER DESIGN FOR PROPELLANT CHARGES AND POWER ADJUSTMENT MEANS

BACKGROUND OF THE INVENTION

1. Field of the Invention

The present invention is directed to a combustion chamber design for propellant charges used in powder actuated devices, and, in particular, to a novel orifice plate which increases combustion efficiency and cleanliness. The combustion chamber promotes complete combustion of the propellant charge thus enabling the use of a power adjustment system which is both clean and has high energy consistency.

2. Description of the Prior Art

The predominant design for propellant (also known as powder actuated) charges which are currently available features a cylindrical brass casing which contains the propellant material and an ignition material. The propellant is a granular, flake, or fibrous form of nitrocellulose with additives. The open end of the brass casing is usually crimped while the opening is sealed using a wax-like substance. Ignition is attained by a technique known as rim fire. On the closed end of the brass casing, a rim area is formed. A percussion sensitive material is coated on the internal surfaces of the rim. When the firing pin impacts and collapses the rim, the percussion sensitive material reacts, and the gaseous decomposition products proceed to ignite the propellant starting with the grains or flakes which are adjacent the rim. The resultant gases and heat produced increase the pressure in the cartridge causing the sealed end of the cartridge to open. The outrush of gases from the casing carries unspent propellant into the volume on top of the driver. When the unspent propellant is forced into the clearance between the driver and its bore, the combustion is suppressed due to the reduction of pressure and temperature. The high ratio of surface area to volume in the driver-bore clearance area robs the gas/solids mixture of heat, which also contributes to the cessation of combustion. Thus, as the driver travels down the bore, unspent propellant combustion products are deposited. A number of undesirable results stem from this process: the bore can be fouled; power variance is increased due to the randomness of the incomplete combustion; and the unspent propellant can be scraped up on the return of the driver thus increasing the propellant mass of the subsequent shot. All of this results in higher shot to shot energy variance. Examples of this prior art are shown in U.S. Pat. No. 4,493,376.

Another type of propellant charge is termed caseless in that a brass casing is not used as a container for the charge. Combustion cleanliness is limited in this type of tool due to a mechanism similar to that of cartridge tools; that is, during combustion, the propellant is pushed down the bore into the clearance between the driver and the bore where combustion is suppressed due to the reduction of pressure and temperature. Examples of this art are shown in U.S. Pat. Nos. 5,208,420, 3,899,113, and 3,973,708.

Power adjustment is provided in some prior art powder actuated tools by means of a mechanical linkage which adjusts the initial position of the driver in its bore. Full power is attained when the driver is allowed to assume its initial position closest to the cartridge. Note that a minimum initial volume is provided in order to limit the peak combustion pressure. Increasingly lower power settings are achieved as the driver is initially positioned further down the bore and thus away from the cartridge. As a result of positioning the driver down the bore, two power reducing mechanisms are executed. The first mechanism is that the initial volume is increased; thus, lower combustion pressure and temperature are achieved, but also less combustion efficiency. The second mechanism is that as the driver is positioned closer to the tool's exhaust port, the chambered length is reduced. Both mechanisms have limitations and cause related problems. Increasing the initial combustion chamber volume aggravates the combustion of the propellant in that the pressure and temperature are reduced and also the surface area is increased; thus, more propellant remains uncombusted. There is a limit as to how much the power can be reduced by varying the initial combustion volume since, if the volume is too great, the propellant merely falls out of the casing, and very little combustion takes place except in the area of ignition. Repeating this procedure allows accumulation of unspent propellant which fills the intial volume and results in a dangerously large propellant mass. Meanwhile, reducing the chambered length reduces the time and distance available for combustion to take place. Also, the effect of collecting unspent propellant on the return of the driver is increased, thus causing more shot to shot energy variance. Another problem is that the exhaust gas contains a higher concentration of hydrocarbons which can be toxic. On tools of this type, unspent propellant is observed on internal surfaces of the tool's exhaust area, which can accumulate and result in an unsafe condition. Examples of this type of prior art are shown in U.S. Pat. Nos. 4,877,171; 3,746,235; 4,068,790; 4,374,567 and 4,824,003.

Another type of power adjustment mechanism operates by a valve which vents the combustion gases to either the atmosphere or in an exhaust chamber or muffler. The shortcomings of this venting technique are similar to the volume adjustment technique in that inadequate time, pressure and temperature are achieved in order to fully combust the propellant; thus, the resultant unspent propellant and by-products may foul the tool. This type of system is taught in U.S. Pat. No. 4,119,257.

Consequently, a need exists for a combustion chamber design that can completely combust the propellant even when a power adjustment means is employed.

It is thus an object of the present invention to provide a combustion chamber which combusts completely and cleanly with a sustainably low level of solid combustion products which can be carried out of the combustion chamber with the flow of the gaseous combustion products.

It is also an object of the present invention to provide a power adjust means which in conjunction with said combustion chamber promotes clean and complete combustion at all power levels.

It is further an object of the present invention to provide a combustion chamber which in conjunction with traditional power adjust means promotes complete and clean combustion at all power levels.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the prior art and the present preferred embodiment of the invention, examples of which are illustrated in the accompanying drawings, wherein like numerals indicate the same elements throughout the views.

DETAILED DESCRIPTION OF THE DRAWINGS

Figure 1:
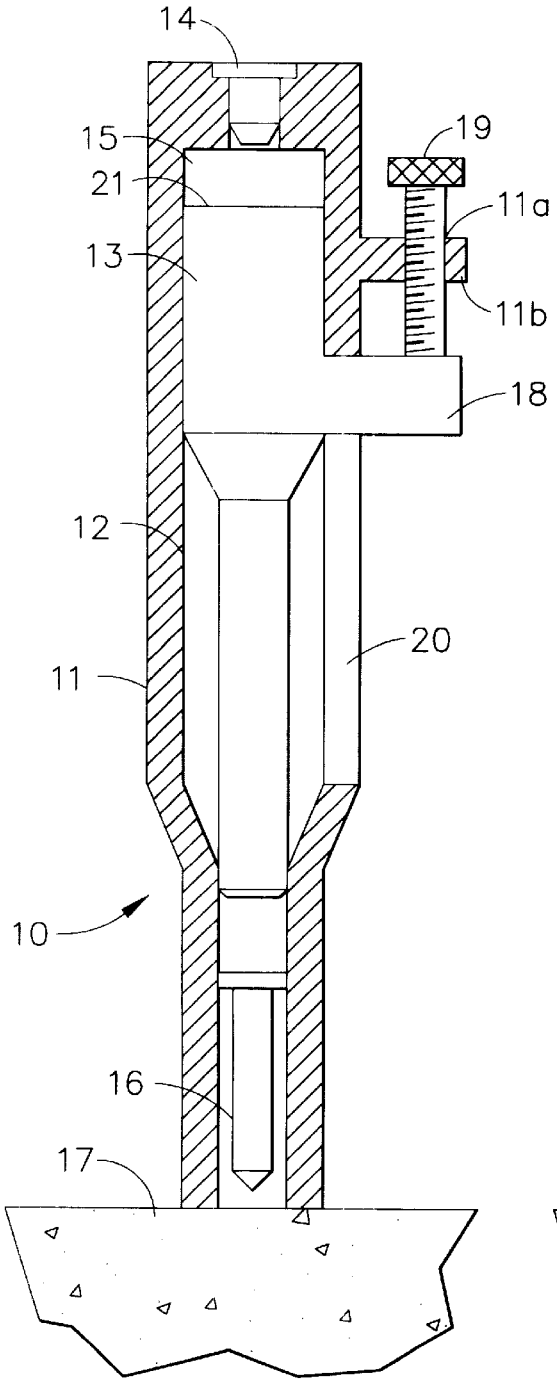
FIG. 1 (PRIOR ART)
FIG. 1 is a sectional view of a propellant tool for driving nails that is constructed according to the prior art.

Referring now to the drawings, FIG. 1 is a sectional view of a propellant tool, generally designated at 10, that is constructed in accordance with the principles of the prior art. Propellant tool 10 consists of a housing 11 which contains a bore 12 which guides the reciprocating travel of a driver 13. Tool 10 operates by igniting a propellant charge or cartridge 14 which pressurizes a combustion chamber 15, forcing driver 13 down bore 12 to drive a fastener 16 into a work surface 17. The combustion gases generated by the ignition of charge 14 are exhausted through a slot 20 in housing 11. As can be seen in FIG. 1, a power adjust arm 18 and an adjustment means 19, which is in contact with power adjust arm 18, are depicted in the highest power setting. Adjustment means 19 is threadedly engaged within opening 11*a* within extension 11*b* of housing 11. In this position, the initial volume of combustion chamber 15 is at its minimum; resulting in higher combustion pressure and efficiency.

Figure 2:
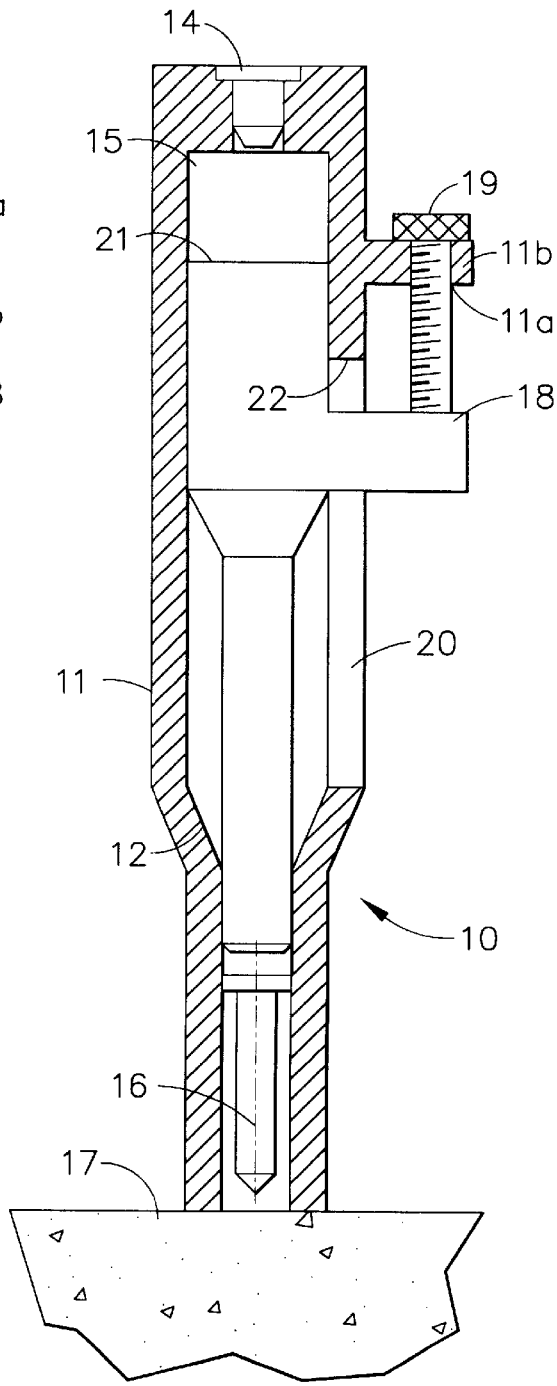
FIG. 2 (PRIOR ART)
FIG. 2 is the propellant tool of FIG. 1 with the power adjustment feature fully deployed.

The lowest power setting of the prior art power adjustment means is shown in FIG. 2. Adjustment means 19 has been set to locate the initial position of driver 13 further down bore 12, thus increasing the initial volume of the combustion chamber 15. Note that the initial position of the upper surface 21 of driver 13 is above upper surface 22 of exhaust slot 20. This assures that some combustion pressure will be obtained. If initial position of driver upper surface 21 were below upper surface 22 of exhaust slot 20, very little pressure and combustion would result.

Figure 4:
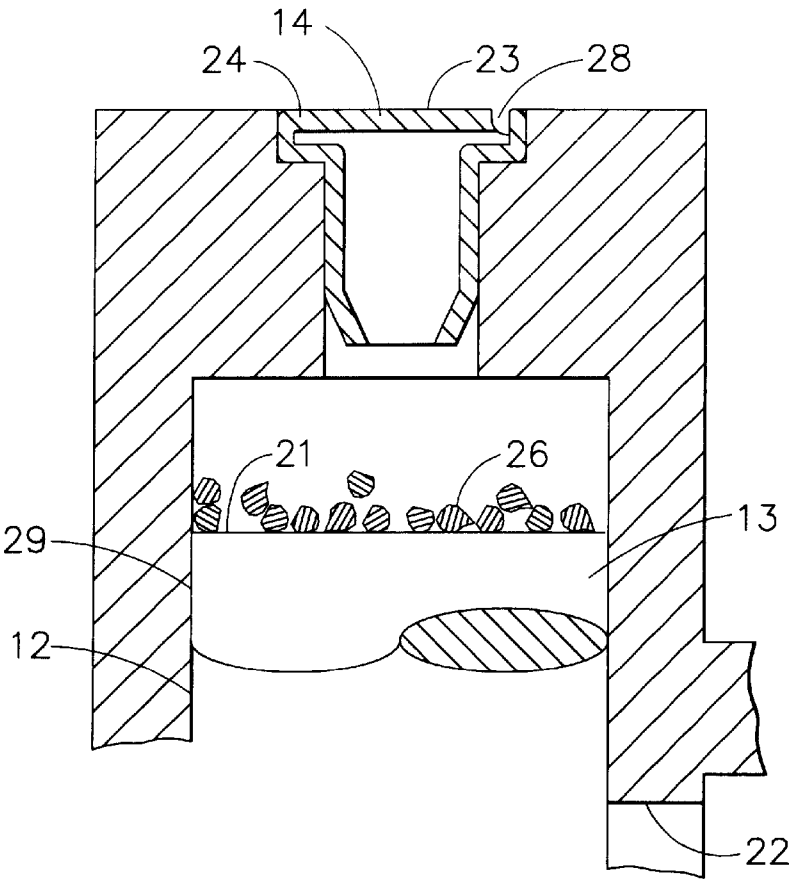
FIG. 4 (PRIOR ART)
FIG. 4 is an enlarged sectional view of the combustion chamber of the propellant tool illustrated in FIG. 1 after ignition and during propellant combustion.
Figure 3:
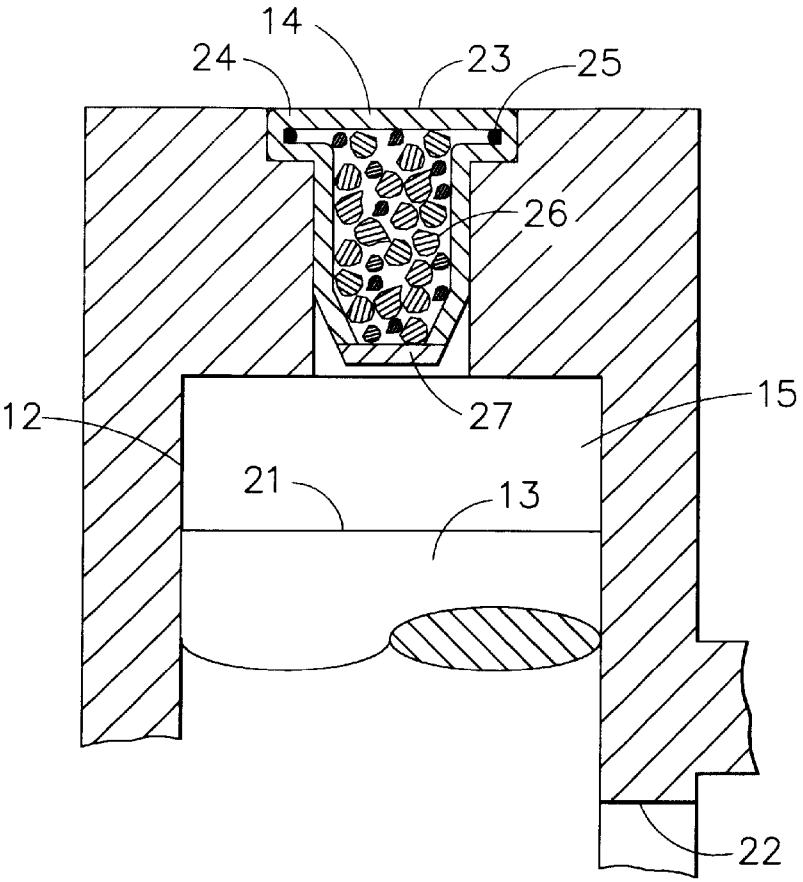
FIG. 3 (PRIOR ART)
FIG. 3 is an enlarged sectional view of the combustion chamber of the propellant tool illustrated in FIG. 1 in a ready to fire condition.

The prior art combustion chamber is depicted in an enlarged sectional view in FIG. 3. Cartridge 14 consists of a cartridge casing 23 having a flange 24 at one end, with a ring of a percussion sensitive material 25 located within flange 24 of cartridge casing 23. The remainder of cartridge 14 is filled with propellant grains 26, while the end of casing 23 opposite flange 24 is crimped and sealed with a wax-like substance 27. The prior art combustion chamber during combustion is depicted in FIG. 4. Here, cartridge flange 24 has been collapsed as shown at 28 by a firing pin (not shown). Percussion sensitive material 25 in collapsed area 28 has ignited the adjacent propellant grains 26, while the pressure generated has opened the crimp and blown off wax-like substance 27 from cartridge 124. The outrush of gas has carried unspent propellant grains 26 to driver surface 21. A portion of propellant grains 26 continue to combust while some propellant is forced into a clearance space between driver 13 and bore 12. Here, the reduced pressure and temperature suppresses combustion, resulting in tar-like substances deposited on bore 12. As driver 13 is propelled down bore 12, when the driver surface 21 travels past exhaust slot top 22, and a portion of the remaining propellant is forced out through slot 20 by the outrushing exhaust gases. Also at this time, the pressure and temperature is greatly reduced and combustion essentially ceases. Another portion of the unspent propellant remains in bore 12 and on driver upper surface 21. Upon return of driver 13 to the initial position, this unspent propellant is shifted up into combustion chamber 15. Thus the subsequent shot, by virtue of the higher charge mass, has higher pressure and temperature, burns the propellant more completely, and results in higher drive energy. Thus, less unspent propellant is present within combustion chamber 15 for a subsequent shot. This mechanism explains much of the shot to shot energy variance, especially at low power settings.

Figure 5:
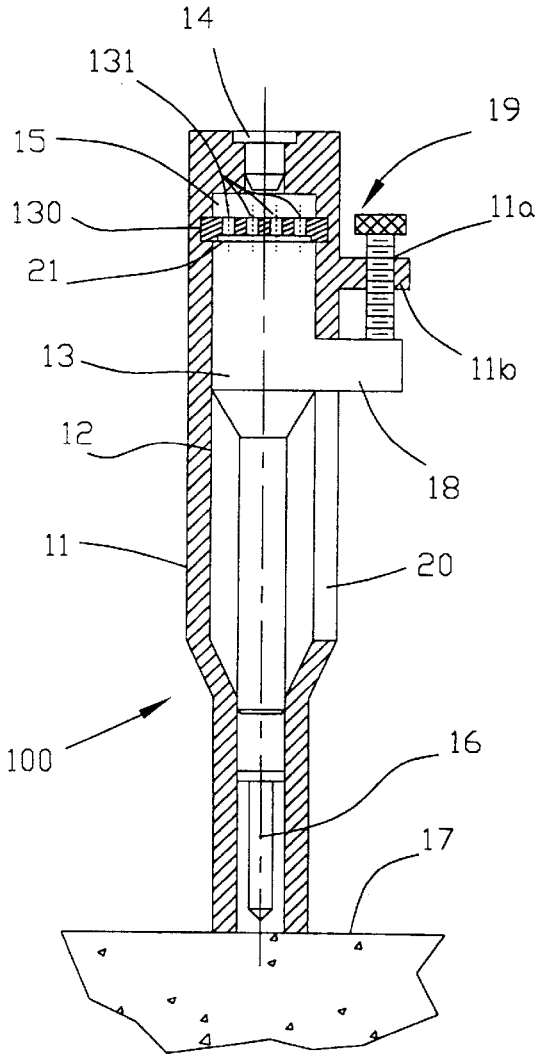
FIG. 5 is a sectional view of a propellant tool for driving nails that is constructed according to the principles of the present invention.
Figure 6:
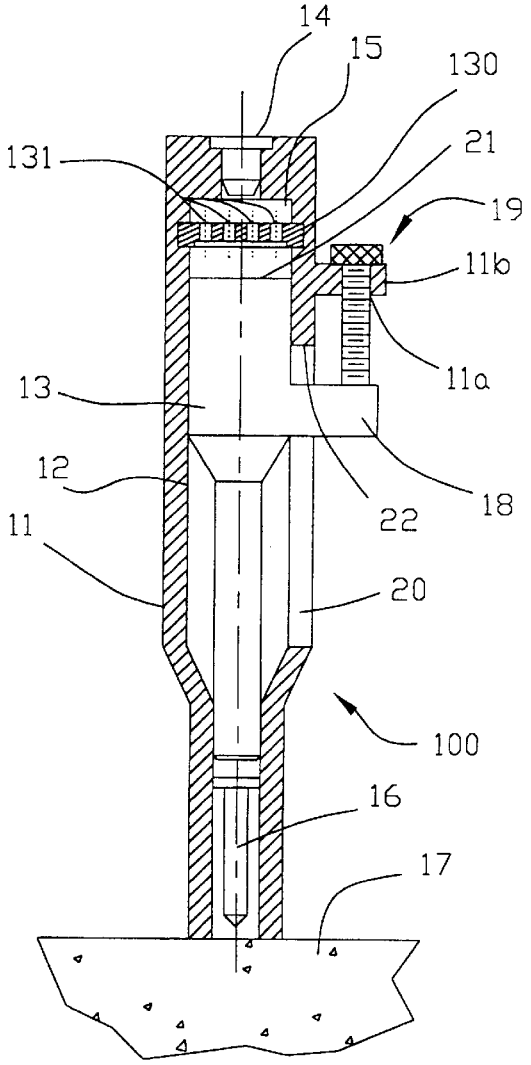
FIG. 6 is the propellant tool of FIG. 5 with the power adjustment feature fully deployed.

FIG. 5 is a sectional view of a propellant tool, generally designated at 100, that is constructed in accordance with the principles of the present invention. Propellant tool 100 includes all the elements of tool 10 shown in FIGS. 1–4 with the addition of an orifice plate 130 located within combustion chamber 15 between cartridge 14 and upper driver surface 21. Also in FIG. 5, the power adjustment means 19 is shown at the highest power setting. A lower power setting of the present invention is shown in FIG. 6.

Figure 8:
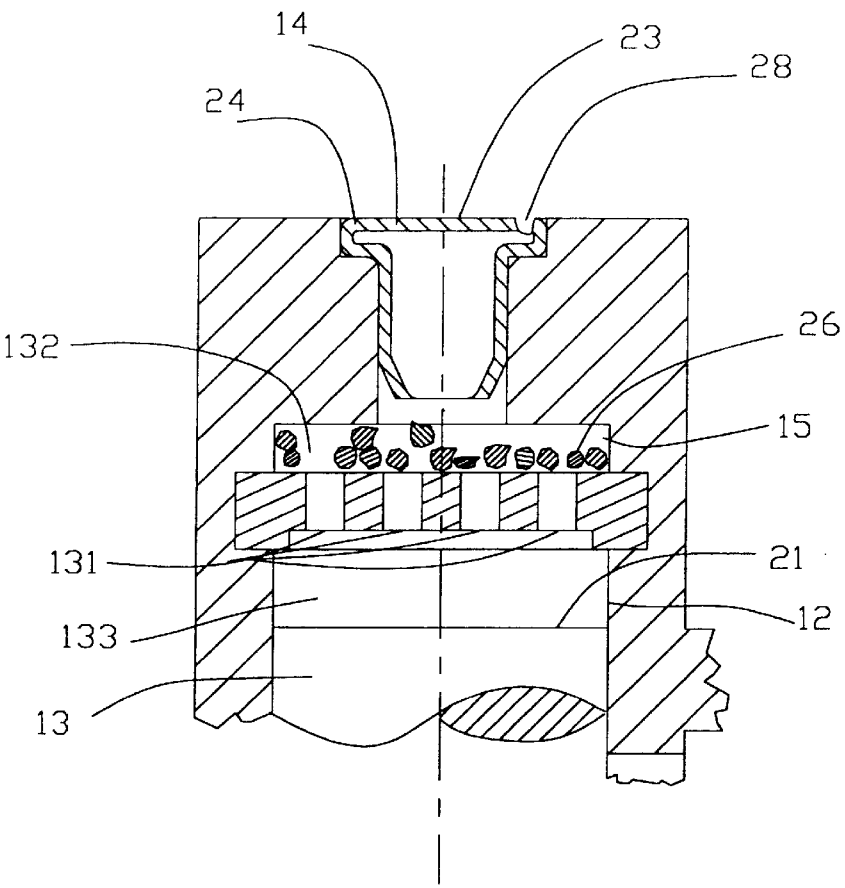
FIG. 8 is an enlarged sectional view of the combustion chamber of the propellant tool illustrated in FIG. 5 during propellant combustion.
Figure 7:
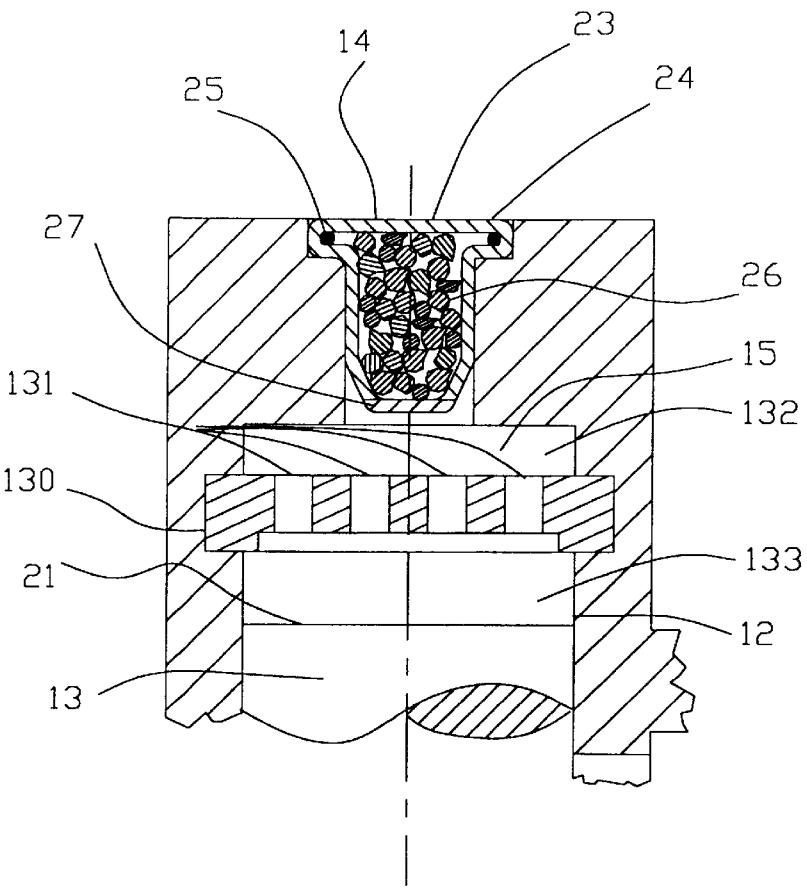
FIG. 7 is an enlarged sectional view of the combustion chamber of the propellant tool illustrated in FIG. 5 in a ready to fire condition.

The combustion chamber 15 of the present invention, depicted in an enlarged sectional view in FIG. 7, contains an upper volume chamber 132 and a lower volume chamber 133. All the elements of the prior art are present with the addition of orifice plate 130. The present invention combustion chamber 15 during combustion is depicted in FIG. 8. Note that during combustion, propellant grains 26 are caught in the upper volume chamber 132 above orifice plate 130. Propellant grains 26 must be at least partially combusted in order to pass through a plurality of orifice holes 131 located within orifice plate 130. Thus, orifice holes 131 prevent propellant grains 26 from being combusted in lower volume chamber 133, and therefore assures complete combustion and clean sustained tool operation. The mechanism works even when lower volume chamber 133 is large, as is the case for low power setting while employing the power adjust feature. Note that even without driver 13 present; sufficient time, pressure, and temperature is achieved to completely combust the propellant material.

In the preferred embodiment of the invention, orifice holes 131 are sized such that they are slightly smaller than the largest dimension of the propellant grains 26. Thus for a spherical (or ball) powder, orifice holes 131 would be equal to or smaller than the diameter of the sphere. For a flake powder, the orifice holes 131 would be equal to or smaller than the length of the flake. For a fibrous propellant, orifice holes 131 would be less than the length of the fiber. The number of orifice holes 131 is calculated to allow sufficient flow to avoid extreme pressure buildup in upper volume chamber 132 when driver 13 is being propelled downwardly within bore 12. Note that the shape of orifice holes 131 need not be circular; thus, slots, squares, slits, or irregular shapes will work as well.

Figure 9:
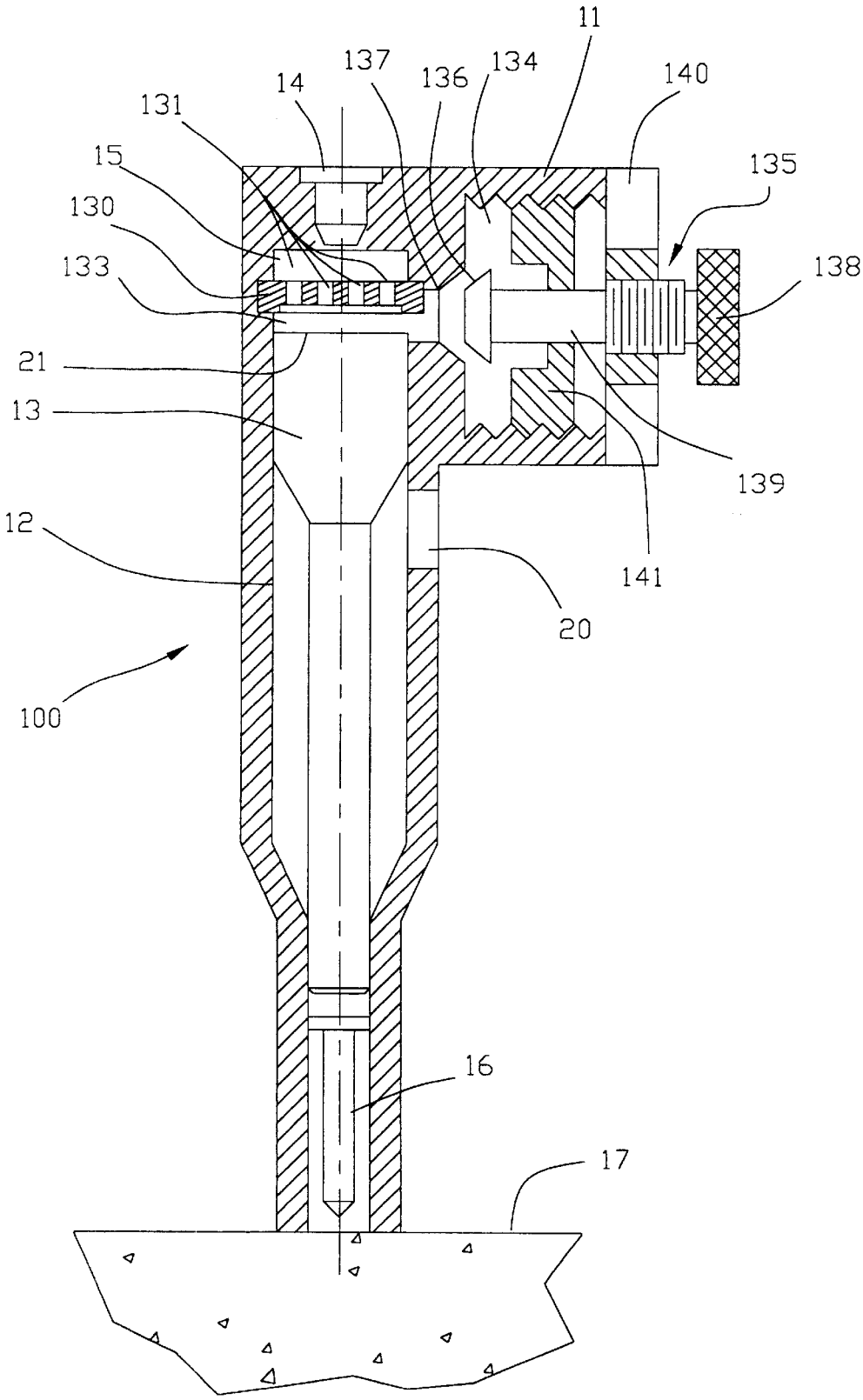
FIG. 9 is a sectional view of a propellant tool that is constructed according to the principles of the present invention with an alternate arrangement for power adjustment.

An alternative novel arrangement of a power adjustment means is depicted in sectional view shown in FIG. 9. In this arrangement, combustion chamber 15 of tool 100 is selectively augmented by an additional adjustable volume chamber 134. Adjustable volume chamber 134 is opened to lower volume chamber 133 by a valve 135. Valve 135 consists of a valve seat 136, which is accommodated within a passage 137 (which connects volume chamber 133 to volume chamber 134) and acts to open and close passageway 137. Valve seat 136 is coupled to an adjustable knob 138 by a valve stem 139, while stem 139 is threadedly engaged with a support member 140 which is affixed to housing 11. In operation, the portion of seat 136 relative to passageway 137 is adjusted by rotating knob 138, thus, additional volume chamber 134 can be selectively connected to lower volume chamber 133.

In addition, the size of additional volume chamber 134 can be varied by adjustment of a movable plate 141. In the present embodiment, plate 141 is threadedly engaged within adjustable volume chamber 134 such that the position of plate 141 can be adjusted by rotating plate 141, which is accomplished by inserting a suitable tool into adjustable volume chamber 134 through openings within support member 140. As plate 141 is shifted towards passageway 137, the size of adjustable volume chamber 134 is reduced, increasing drive power, while shifting plate 141 toward support member 140 increases the size of adjustable volume chamber 134, reducing the pressure in volume chamber 133, and thus reducing the acceleration, velocity, and energy available to driver 13. The diverted energy is released when driver upper surface 21 passes exhaust slot 20 of tool 100.

Figure 10:
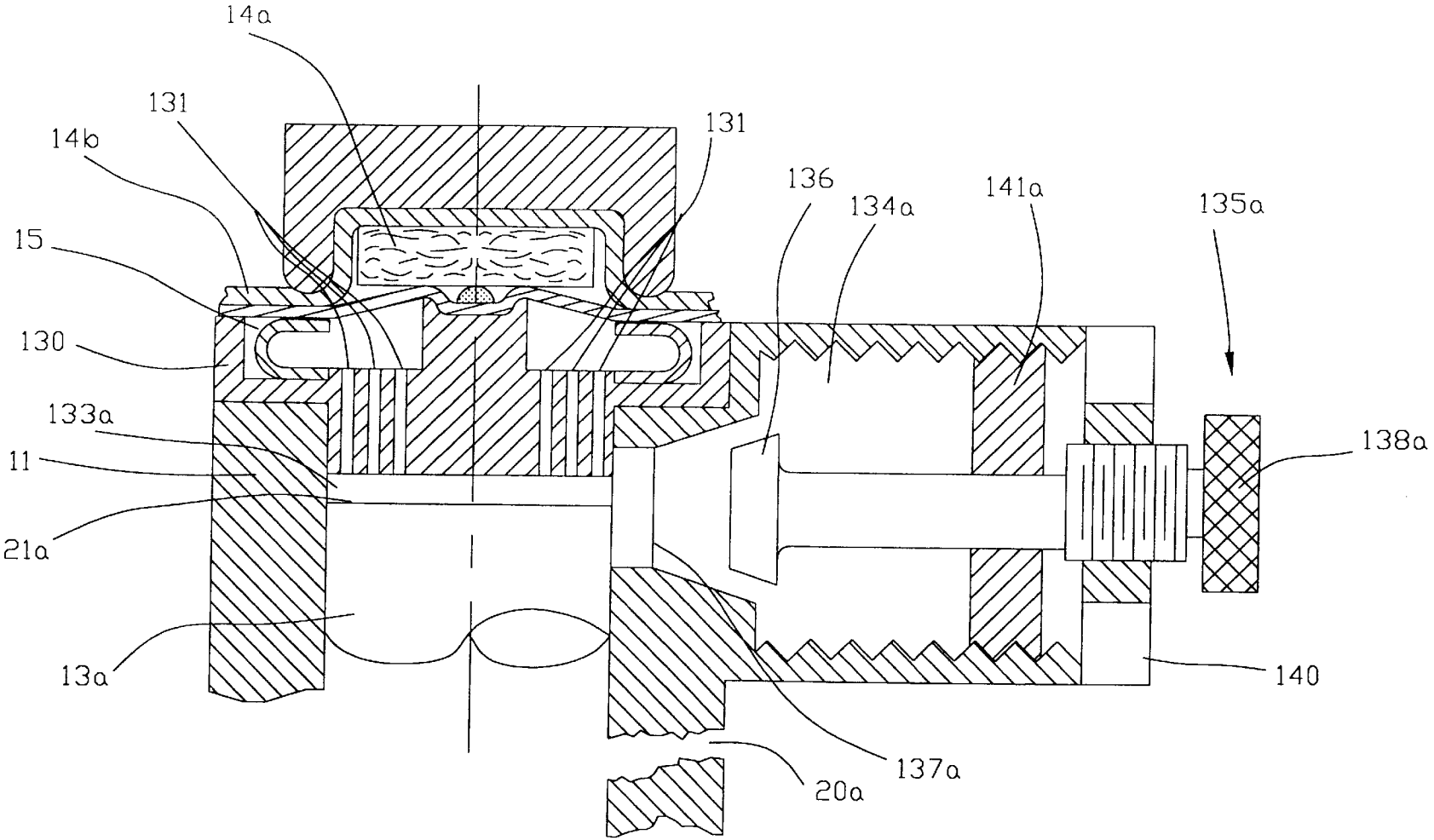
FIG. 10 is a sectional view of a propellant tool using caseless charges that is constructed according to the principles of the present invention with an alternate arrangement for power adjustment.

Another alternative novel arrangement of a power adjustment means, in this case applied to a caseless charge 14*a*, is depicted in sectional view in FIG. 10. Caseless charge 14*a* is contained within a strip assembly 14*b* in this particular embodiment. In this arrangement, lower volume chamber 133*a* is selectively augmented by an additional adjustable volume chamber 134*a*. This volume is opened to the lower volume chamber 133*a* by valve 135*a* which is controlled by knob 138*a*, and adjustment to adjustable volume chamber 134*a* is obtained by movable plate 141*a* in a similar manner as previously described with respect to FIG. 9; thus, more volume results in lower drive power. In operation, combustion gases flow into adjustable volume chamber 134*a* through passageway 137*a* which is opened by seat 136*a* of valve 135*a*. Adjustable volume chamber 134*a* acts to reduce pressure in volume chamber 133*a*, thus reducing the acceleration, velocity and energy available to driver 13*a*. The diverted energy is released when upper surface 21*a* of driver 13*a* passes the exhaust port 20*a*.

While this invention has been shown and described in terms of a preferred embodiment thereof, it will be understood that this invention is not limited to this particular embodiment and that any changes and modifications may be made without departing from the true spirit and scope of the invention as defined in the appended claims.

The foregoing description of a preferred embodiment of the invention has been presented for purposes of illustration and description. It is not intended to be exhaustive or limit the invention to the precise form disclosed, and many modifications and variations are possible in light of the above teaching. The embodiment was chosen and described in order to best explain the principles of the invention and its practical application to thereby enable others skilled in the art to best utilize the invention and various embodiments and with various modifications as are suited to the particular use contemplated. It is intended that the scope of the invention be defined by the claims appended hereto.

What is claimed is:

1. A device for varying the driving force of a propellant actuated fastener driving tool of type having a body, a cylindrical bore having an upper section and a lower section located within said body, a drive assembly having an upper surface slidably mounted within said cylindrical bore and movable between an unactuated rest position and an actuated fastener driving position, a solid propellant charge, and means for positioning said propellant charge within the upper section of said bore above said drive assembly such that when said propellant is ignited said driver assembly shifts to said actuated position to drive a fastener from the tool, said device comprising:

an orifice plate, rigidly affixed within said upper section and separating said upper section of said bore into an upper chamber having a fixed volume between said orifice plate and said propellant positioning means and a lower chamber having a variable volume between said orifice plate and said driver assembly upper surface, said orifice plate containing a plurality of apertures, said plurality of apertures being of a size and configuration slightly smaller than the largest dimension of propellant fragments of said solid propellant charge so as to prevent said propellant fragments from travelling from said upper chamber to said lower chamber upon ignition of said propellant, ensuring complete combustion of said propellant charge;

and means coupled to said driver assembly and located external to said bore of said tool, for varying the distance between said orifice plate and said driver assembly when said assembly is in the unactuated rest position, whereby varying the volume of said lower chamber and varying the force acting upon said driver assembly upon combustion of said propellant charge.

2. The device of claim 1, wherein said apertures within said orifice plate are circular.

3. A propellant actuated tool for driving fasteners by combustion of a propellant, comprising:

a body;

a cylindrical bore within said body having an upper end and a lower end;

a driver assembly having a upper surface and being shiftable within said bore between a first unactuated position near said upper end and a second actuated fastener driving position near said lower end;

a solid propellant charge; means for positioning said solid propellant charge within said upper end of said bore;

an orifice plate having a plurality of apertures, rigidly affixed within said upper end of said bore between said propellant positioning means and said driver assembly, forming a first chamber having a fixed volume between said orifice plate and said positioning means and a second chamber between said orifice plate and said upper surface of said driver assembly, with said apertures within said orifice plate sized to inhibit fragments of said solid propellant from travelling into said second chamber; an auxiliary second chamber, coupled to said second chamber through a passageway;

and valve means for selectively opening and closing said passageway between said second chamber and said auxiliary second chamber to selectively vary the volume within said second chamber;

whereby the driving force available for propelling said driver assembly to said actuated fastener driving position from said first unactuated position may be varied by said valve means.

4. The tool of claim 3, wherein said apertures within said orifice plate are circular.

5. The tool of claim 3, wherein said apertures within said orifice plate are square.

6. The tool of claim 3, wherein said auxiliary second chamber is provided with a movable plate within said chamber to vary the volume within said auxiliary second chamber.

7. The tool of claim 6, wherein said plate is rotatably mounted within said auxiliary second chamber and is rotated to vary its position within said auxiliary second chamber.

8. The tool of claim 3, wherein selective opening and closing of said valve means is accomplished by rotation of an adjustment knob.

9. The tool of claim 8, wherein said adjustment knob is located outside said body.

10. The tool of claim 3, wherein said solid propellant charge comprises a cartridge casing containing a plurality of individual propellant grains.

11. The tool of claim 3, wherein said solid propellant charge comprises a caseless charge contained within a carrier strip assembly.

12. The tool of claim 3, wherein said body is provided with an exhaust aperture whereby the interior of said second chamber communicates with the exterior of said tool when said driver assembly is positioned within said bore below said exhaust aperture.

13. The tool of claim 3, wherein said valve means includes a valve seat which is accommodated within said passageway between said second chamber and said auxiliary second chamber to close said passageway.

* * * * *